US005594537A

United States Patent [19]

Hasegawa

[11] Patent Number: 5,594,537

[45] Date of Patent: Jan. 14, 1997

[54] IMAGE FORMING APPARATUS WITH TRANSFER MATERIAL SUPPORT MEMBER

[75] Inventor: Yuji Hasegawa, Tokyo, Japan

[73] Assignee: Canon Kabushiki Kaisha, Tokyo, Japan

[21] Appl. No.: 384,685

[22] Filed: Feb. 6, 1995

Related U.S. Application Data

[63] Continuation of Ser. No. 998,864, Dec. 30, 1992, abandoned.

[30] Foreign Application Priority Data

Jan. 9, 1992 [JP] Japan ..... 4-019384

[51] Int. Cl.[6] ..... G03G 15/14

[52] U.S. Cl. ..... 399/318; 399/310

[58] Field of Search ..... 355/272, 274, 355/275, 277, 271, 326, 327

[56] References Cited

U.S. PATENT DOCUMENTS

| | | | |
|---|---|---|---|
| 4,114,536 | 9/1978 | Kaneko et al. | 355/277 |
| 4,766,463 | 8/1988 | Watanuki et al. | 355/272 |
| 4,862,214 | 8/1989 | Kasahara et al. | 355/277 |
| 5,021,835 | 6/1991 | Johnson | 355/271 |
| 5,132,737 | 7/1992 | Takeda et al. | 355/271 |
| 5,140,379 | 8/1992 | Johnson | 355/272 X |

FOREIGN PATENT DOCUMENTS

| | | | |
|---|---|---|---|
| 0400996 | 5/1990 | European Pat. Off. . | |
| 0401977 | 12/1990 | European Pat. Off. . | |
| 55-32079 | 3/1980 | Japan . | |
| 56-119166 | 9/1981 | Japan . | |
| 60-239786 | 11/1985 | Japan . | |
| 0083557 | 4/1986 | Japan . | |
| 61-226766 | 10/1986 | Japan . | |
| 2148058 | 6/1990 | Japan . | |
| 0178680 | 7/1990 | Japan | 355/272 |
| 0211462 | 8/1990 | Japan | 355/274 |
| 0192273 | 8/1991 | Japan | 355/274 |
| 0024677 | 1/1992 | Japan | 355/274 |

*Primary Examiner*—Robert Beatty
*Attorney, Agent, or Firm*—Fitzpatrick, Cella, Harper & Scinto

[57] ABSTRACT

An image forming apparatus includes a rotatable image bearing member, and a transfer material support having a circumferential length an integer multiple of that of the image bearing member for supporting and transporting a transfer material. An image formed on the image bearing member is transferred at a transfer position onto the transfer material supported by the transfer material support. The image forming apparatus also includes a press member for pressing the transfer material support against the image bearing member at the transfer position. A varying device varies a relative position between the peripheral surfaces of the image bearing member and the transfer material support without shifting the transfer material support away from the image bearing member. A release device releases pressing of the transfer material support against the image bearing member by the press member when the varying device varies the relative position of the image bearing member and the transfer material support.

10 Claims, 3 Drawing Sheets

IMAGE FORMING APPARATUS WITH TRANSFER MATERIAL SUPPORT MEMBER

This application is a continuation of application Ser. No. 07/998,864, filed Dec. 30, 1992, now abandoned.

BACKGROUND OF THE INVENTION

1. Field of the Invention

The present invention relates generally to an image forming apparatus, and more particularly to an image forming apparatus for obtaining an image by transferring a visible image (toner image), formed on an image bearing member by an electrophotographic process or an electrostatic recording process, onto a transfer material supported on a transfer material support member of a transfer device. Such image forming apparatuses include black-and-white, monochromatic or full-color electrophotographic copying machines, printers and other recording equipment.

2. Related Background Art

Among various image forming apparatuses of the electrophotographic or electrostatic recording type, there is already known a color electrophotographic copying apparatus capable of copying a full-color image, as disclosed in Japanese Patent Appln. Laid-Open No. 55-32079. Said apparatus transfers color toner images, formed on a photosensitive drum constituting the image bearing member, one by one in superposed manner onto a sheet-shaped transfer material supported on a transfer drum constituting the transfer material support means, by means of a transfer charger. A known structure of the transfer drum consists of two mutually opposed ring portions, a connecting portion for said ring portions, and a transfer material supporting sheet covering an aperture formed by said ring portions and connecting portion.

Such transfer drum is designed so that the peripheral length thereof can sufficiently accommodate the transfer sheet of the maximum size to be used, and the size of the photosensitive drum is selected so that the ratio of the peripheral length of the photosensitive drum to that of the transfer drum is an integer (L2/L1 or L1/L2 is an integer, wherein L1 is the peripheral length of the photosensitive drum, while L2 is that of the transfer drum). For example, if the transfer drum has a diameter of 160 mm, the diameter of the photosensitive drum is selected as 80 or 160 mm. Though the periodical fluctuation in the load of the photosensitive drum or the transfer drum is a major cause of aberration in colors because of the fluctuation in the rotating speed, such aberration in colors rarely appears in the case of the above-mentioned integral ratio, because the extension or contraction takes place similarly for each of the in different colors. If such integral ratio is not adopted, then the aberration in colors because of the above-mentioned cause is unavoidable, and it is extremely difficult to reduce such aberration in colors even with improvements in the driving means.

However, such integral ratio between the diameters of the photosensitive drum and the transfer drum gives rise to a shortened service life of the photosensitive drum, because of the following reasons:

(1) the transfer sheet, the connecting portion and the leading end of the transfer material supporting sheet impinge repeatedly on same positions of the photosensitive drum, thereby causing damage thereto; and (2) charging by the transfer charger takes place strongly or weakly, depending on the position, such as the leading or trailing end of the transfer sheet or the connection portion, and repetition of such charging in the same position causes a memory on the photosensitive drum (charge memory).

These drawbacks are naturally encountered also when the above-mentioned transfer drum is replaced by a transfer belt not equipped with the ring portions or the connecting portion.

SUMMARY OF THE INVENTION

An object of the present invention is to provide an image forming apparatus capable of preventing damage to the image bearing member, resulting from repeated impingement of an end face of the transfer material onto said image bearing member.

Another object of the present invention is to provide an image forming apparatus capable of preventing damage to on the image bearing member, resulting from repeated impingement of an end face of the transfer material support member to the image bearing member.

Still another object of the present invention is to provide an image forming apparatus capable of preventing generation of transfer charge memory on the image bearing member, resulting from repetition of image transfer.

Still another object of the present invention is to provide an image forming apparatus capable of preventing deterioration of the image bearing member, thereby obtaining images of high quality.

Still other objects of the present invention, and the advantages thereof, will become fully apparent from the following detailed description, which is to be taken in conjunction with the attached drawings.

DETAILED DESCRIPTION OF THE PREFERRED EMBODIMENTS

Figure 1:
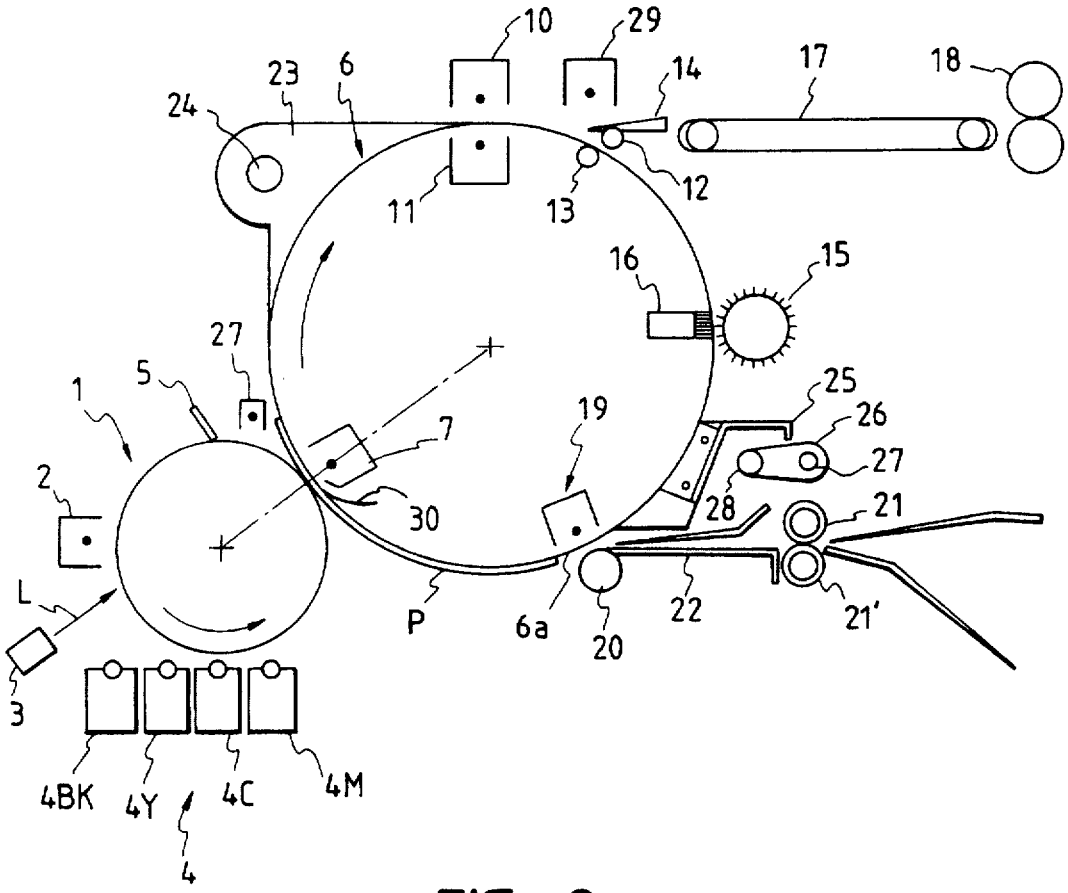
FIG. 1 is a schematic view of an embodiment of the image forming apparatus of the present invention.
Figure 4:
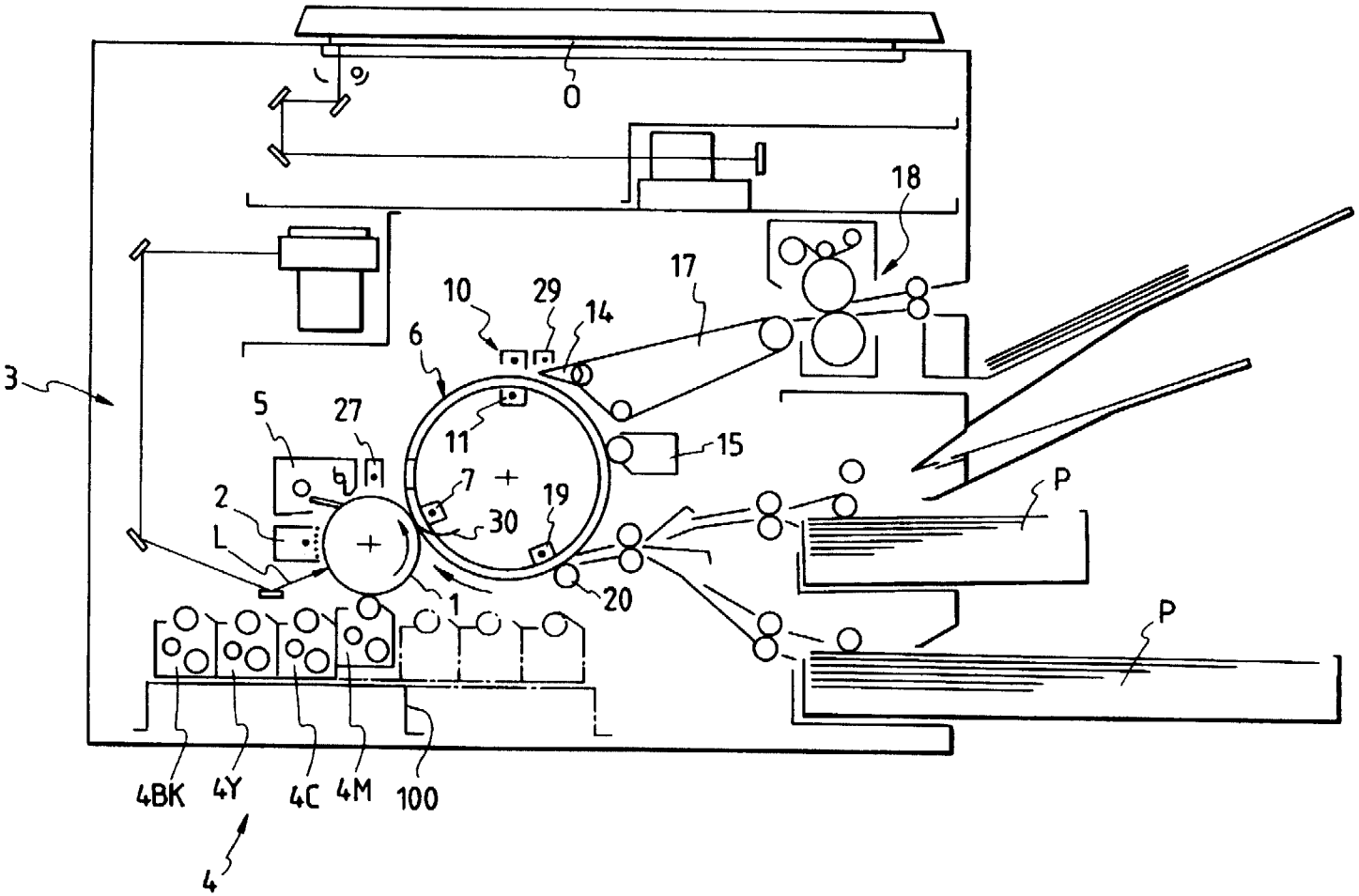
FIG. 4 is a schematic view of an electrophotographic color copying apparatus.

Now the present invention will be clarified in detail by preferred embodiments thereof shown in the attached drawings. FIGS. 1 and 4 illustrate an electrophotographic color copying apparatus, as an embodiment of the image forming apparatus.

In the present embodiment, a photosensitive drum 1, serving as the image bearing member, is rotatably supported and rotated in a direction indicated by an arrow. Opposed to the external periphery of said photosensitive drum 1, there are arranged, along the rotating direction thereof, a primary charger 2, an exposure device 3 and a developing device 4. In the present embodiment, the photosensitive layer is composed of a negatively chargeable organic photoconductive layer. The primary charger 2 provides the photosensitive drum 1 with a uniform negative charge. The exposure device 3 provides the surface of the photosensitive drum 1, at a predetermined timing, with a color-separated optical image or a corresponding light L, thereby forming an electrostatic latent image. The exposure device 3 can be composed for example of a laser beam scanning device. The developing device 4, being supported on a rack 100 and movable tangentially to the surface of the photosensitive drum 1, is composed of four developing units 4M, 4C, 4Y and 4BK, respectively containing developers (toners) of magenta, cyan, yellow and black colors. In response to the irradiation of an optical image or a corresponding light L of a color selected by the exposure device 3, the developing device 4 causes a corresponding developing unit to be positioned opposite to the photosensitive drum 1 and causes the toner to electrostatically fly, thereby developing a toner image on the photosensitive drum 1. In the present embodiment, the toner is negatively charged, and the latent image is reverse developed.

Figure 5:
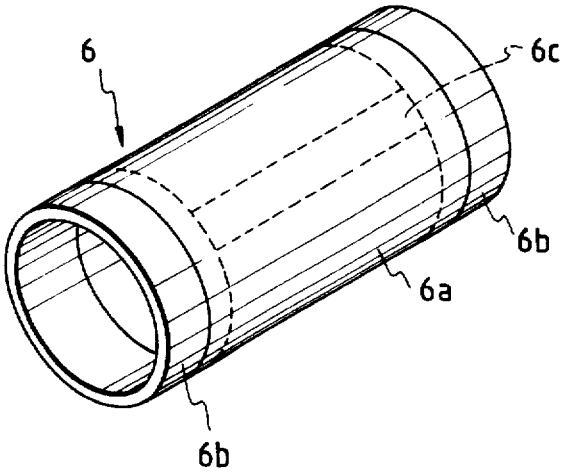
FIG. 5 is a schematic perspective view of a transfer drum.

A transfer device 6 also is arranged in opposed relationship to the photosensitive drum 1 and in contact with the surface thereof. In the present embodiment the transfer device is composed of a transfer drum 6, which is formed, as schematically illustrated in FIG. 5, by a drum frame consisting of cylindrical end rings **6*b* and a connecting portion 6*c* linking rings 6*b*, and a transfer material supporting dielectric sheet 6a wound on said drum frame. Also opposite the photosensitive drum and across the transfer material supporting sheet 6*a*, there is provided a transfer corona charger 7** having a charging polarity the same as that of the latent image.

The transfer drum 6 is rotated in a direction indicated by an arrow, and, in an upstream position with respect to the transfer position where the transfer charger 7 is located, an attraction charger 19 is provided at the rear side of the supporting sheet 62. Also, a grounded conductive roller 20, serving as a charge injection means, is provided facing the supporting sheet 62. Also, at the downstream side of the transfer position, corona chargers 10, 11 for eliminating the charge from the transfer material after image transfer are provided on both side of supporting sheet **6*a*. Further more rollers 12, 13 for separating the transfer material P from the supporting sheet 6*a* are provided on both sides of the supporting sheet 6*a*, and a separating blade 14 is provided in the vicinity thereof. Further downstream, there are provided a brush roller 15 for cleaning the supporting face of the supporting sheet 62, and, if necessary, a corona charger or a charge eliminating brush 16 for eliminating the adhesive force (remaining Coulomb force and Van der Waals force). At the transfer position there is further provided a pressing sheet 30 for pressing the transfer material supporting sheet 6*a* toward the surface of the photosensitive drum 1**.

The transfer material P, separated by the separating blade 14, is supplied through a conveyor 17 to paired fixing rollers 18 for fixing the developed toner images by fusion, with color mixing. Subsequently the transfer material is discharged onto a discharged sheet tray.

The transfer material P, supplied from a sheet cassette or a sheet feeding tray, is supplied through registration rollers 21, 21' and guide members 22, to the supporting face of the supporting sheet **6*a*, at a position upstream of the charger 19 and the conductive roller 20** constituting the charge injection means.

Furthermore, along the periphery of the photosensitive drum 1, there are provided, as shown in FIG. 1, a charge eliminator 27 for eliminating the surface electrostatic charge of the photosensitive drum 1, a cleaning blade 5 for eliminating the remaining toner, and, if necessary, a corona charger 29 for effecting AC discharge, in order to prevent any perturbation in the image, resulting from a peeling discharge at the separation of the transfer material P from the supporting sheet **6*a***.

In the above-explained structure, after the surface of the photosensitive drum 1 is uniformly charged by the primary charger 2, it is exposed to a color image transmitted for example by a green filter, whereby formed is a latent image corresponding principally to the magenta component of the color image. In synchronization with the advancement of said latent image, the developing device 4 effects a movement in the tangential direction of the photosensitive drum 1 in such a manner that the developing unit 4M, containing the magenta toner, is positioned opposite the photosensitive drum 1, whereby magenta toner flies electrostatically to the latent image to develop a magenta image on the photosensitive drum 1.

After the transfer of the magenta image, the toner remaining on the photosensitive drum 1 is subjected to charge elimination by the charge eliminator 27, and is removed by the blade 5 whereby the surface of the photosensitive drum 1 is cleaned. On the other hand, the transfer material P, attracted to the supporting sheet **6*a* and bearing the transferred toner image, moves by rotation of the transfer drum 6 and passes between the corona chargers 10, 11, which are not energized in this state. The rollers 12, 13, the brush roller 15, the corona charger or charge eliminating brush 16 and the conductive roller 20 are all separated from the supporting sheet 6*a*, so that the toner image supported by the Coulomb force on the transfer material P is not perturbed, and is transported to the transfer position again, passing between the corona charger 19 and the conductive roller 20. The energization of the corona charger 19 and the contact of the conductive roller 20** with the transfer material P are completed prior to this arrival of the front end of the toner image on the transfer material P at the position of the corona charger and the roller, so that, at such passing between the corona charger and the conductive roller, a charge for attraction is not given to the transfer material P. Thus, the transfer material P, bearing the magenta image thereon, is then subjected to superposed transfers of a cyan image, a yellow image and a black image, one at a time.

The peripheral length of the transfer drum and that of the photosensitive drum are selected so, that they constitute an integral ratio, in order to prevent aberration in colors. More specifically, the peripheral lengths L1 of the photosensitive drum and L2 of the transfer drum are selected so that L2/L1 or L1/L2 substantially becomes an integer. However, in order to reduce the size of the apparatus and improve in the productivity (number of prints per unit time), a condition $L1<L2$ is desirable, so that the ratio L2/L1 is preferably selected as a substantial integer. In the present embodiment, the diameters of the photosensitive drum and the transfer drum are respectively selected as 80 mm and 160 mm.

The transfer drum 6 is constructed as a unit, and the rotary shaft of the transfer drum 6 is rotatably supported by front and rear lateral plates (rear lateral plate 23 alone is illustrated in FIG. 1), which are rotatably supported by a shaft 24 constituting the center of rotation for pressing and retracting the transfer drum. The lateral plates also have a stay 25 for positioning the transfer drum.

Figure 2:
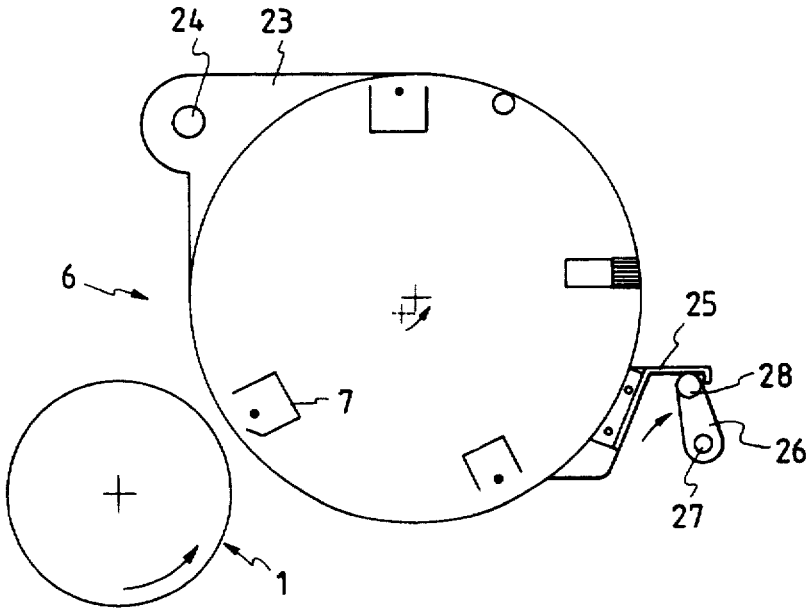
FIG. 2 is a view showing a state in which the transfer drum is shifted to a released position from the photosensitive drum.

In the main body of the apparatus there are provided a lever 26 for pressing or retracting the transfer drum 6, a lever shaft 27 and a roller 28 for receiving the stay 25. The lever shaft 27 rotates the lever 26, by a driving solenoid (not shown), between a transfer drum pressing position shown in FIG. 1 and a transfer drum releasing position shown in FIG. 2. The transfer of the toner image from the photosensitive drum 1 to the transfer material supported on the transfer drum 6 is conducted in said pressing position.

The photosensitive drum 1 and the transfer drum 6 are linked with gears (not shown) for synchronized rotation. Thus the photosensitive drum 1 is rotated by a driving source, and the transfer drum 6 is accordingly driven. In the simplest and securest configuration, these gears are provided, as already known, in flanges at respective ends of the drums and are made to mutually mesh. Consequently, when the transfer drum 6 is pressed to the photosensitive drum 1, the gears of the transfer drum 6 and of the photosensitive drum 1 mutually mesh with a proper axial distance, but, when the transfer drum 6 is retracted from the normal image forming state relative to the photosensitive drum 1, these gears are disengaged whereby the driving force for the photosensitive drum 6 is not transmitted to the transfer drum, so that the transfer drum 6 does not rotate.

In the above-explained configuration, the components are controlled in the following manner.

When a final copy sheet is discharged after a series of copying operations, the brush roller 15 cleans the surface of the supporting sheet 6*a*, and the corona chargers 10, 11 eliminate the charge thereof. Immediately thereafter, the lever shaft 27 is clockwise rotated by the solenoid, thereby retracting the transfer drum 6 to a position shown in FIG. 2. After a predetermined time, the lever shaft 27 is anti-clockwise rotated again by the solenoid, thereby returning the transfer drum 6 to the pressed state shown in FIG. 1. During these operations, the photosensitive drum 1 alone rotates, so that the meshing position of the transfer drum 6 and the photosensitive drum 1, or the peripheral contact position therebetween, is displaced. Naturally, the retracted time does not, preferably, constitute an integral ratio with respect to the rotating time of the photosensitive drum 1.

As explained above, while an image transfer operation is not conducted, the relative relation between the periphery of the photosensitive drum and that of the transfer drum is varied. Prior to such variation, a first area of the photosensitive drum and a second area of the transfer drum are present in the transfer position in the course of the image transfer operation. However, after such variation, the first area of the photosensitive drum and a third area of the transfer drum are present in the transfer position. Naturally the second and third areas are mutually different.

The above-mentioned variation prevents impingement of the end face of the transfer material or the supporting sheet on a same position (the first area) on the photosensitive drum, thus avoiding damage thereto, or the generation of charge memory on the photosensitive drum, resulting from repeated strong charging by the transfer charger 7.

This varying operation need not necessarily be conducted for every series of copying operations, but may be conducted for example, for every 500 or 1000 copies. Also, this varying operation is preferably conducted after the transfer material is separated from the transfer drum, prevent sheet jamming.

Figure 3:
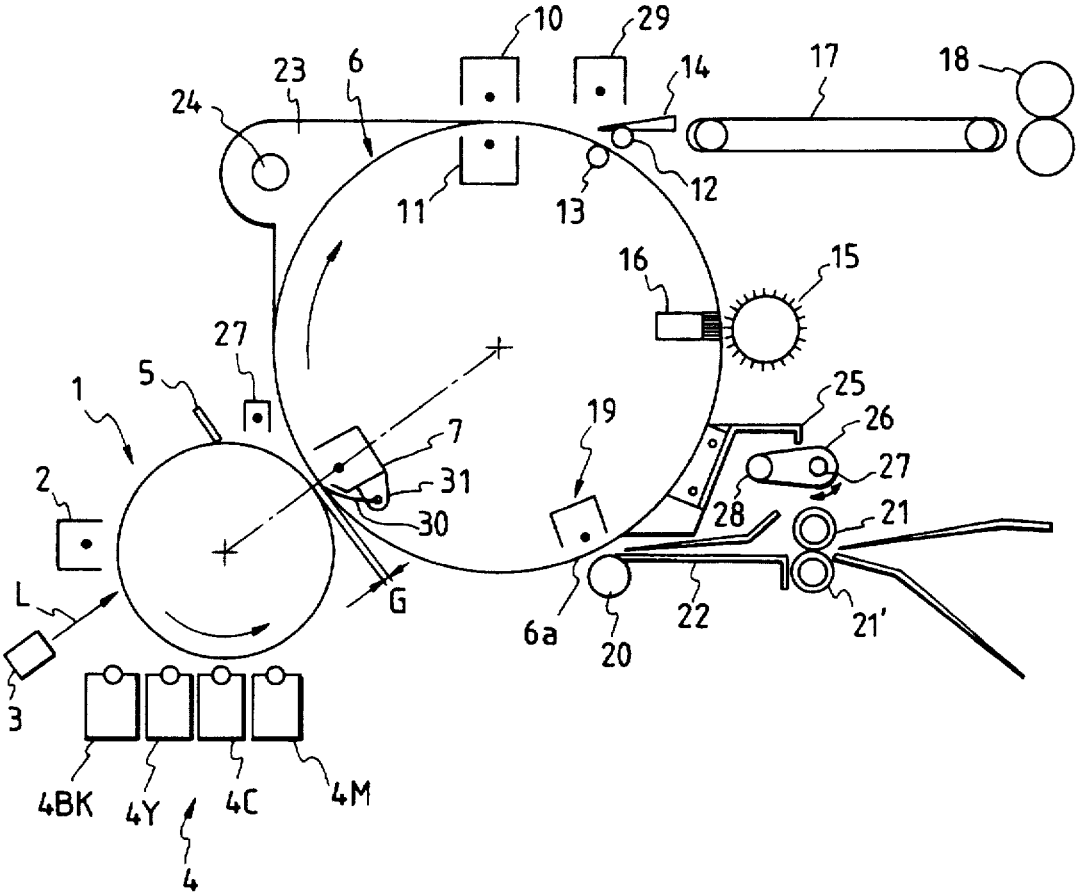
FIG. 3 is a schematic view of another embodiment of the image forming apparatus of the present invention.

FIG. 3 illustrates a second embodiment of the present invention. The image forming apparatus of this embodiment is identical, in overall entire structure and functions, with that in the foregoing first embodiment, and the following description will be devoted only to the different portions.

In the present embodiment, the photosensitive drum 1 and the transfer drum 6 are mutually positioned with a gap G therebetween, and are separately driven with electrical synchronization. Consequently, both abrasion of the engaging portions at the ends of said drums, and fluctuation in rotation, resulting from intrusion of foreign matters are prevented. Gap G is about the thickness of a sheet, and the supporting sheet is pressed from the rear by the pressing sheet 30, in order to prevent defective transfer. Pressing sheet 30 is fixed on a shaft 31 which is rotatably controlled by a solenoid (not shown), in order to effect the pressing only when necessary, for example when the transfer material is present at the transfer position.

In the present embodiment, automatic pressing and releasing of the transfer drum 6 is, unlike the first embodiment, not conducted.

In the above-explained structure, the following operations are performed.

When the last copy sheet is discharged after a series of copying operations, the brush roller 15 cleans the surface of the supporting sheet 6*a*, and the corona chargers 10, 11 eliminate the charge thereof. Then the shaft 31 is rotated by the solenoid, thereby releasing the pressing sheet 30 from the supporting sheet 6*a*. At the same time the transfer drum 6 is stopped for a predetermined time while the photosensitive drum 1 continues to rotate, and then the transfer drum 6 is again put into rotation in synchronization with the photosensitive drum 1. As a result, the peripheral positions of these drums are mutually displaced, and the same effects as in the first embodiment can be attained.

In the foregoing description it is assumed that the transfer drum 6 is stopped for a predetermined time, but it is also possible to displace the off-timings of the drums after a series of copying operations, or to stop the photosensitive drum 1, or to temporarily vary the speeds of these drums instead of stopping. In any case, since the pressing sheet 30 is retracted, the danger of damage by mutual friction of the photosensitive drum 1 and the supporting sheet 6*a* of the transfer drum is avoided.

In the foregoing embodiments there is employed a transfer drum for supporting the transfer material, but there may be employed a transfer belt instead.

The transfer charge memory on the image bearing member tends to appear frequently in case the of a reverse development process, in which the charge polarity of the latent image is the same as that of the toner image, or the charge polarity of the latent image is opposite to the charge polarity of image transfer. Consequently, in the case of such a reverse development process, it is preferable to vary the relative relation between the peripheral position of the image bearing member and that of the transfer drum, to prevent the transfer charge memory phenomenon mentioned above.

The present invention is not limited by the foregoing embodiments, but is subject to any and all modifications within the scope and spirit of the appended claims.

What is claimed is:

1. An image forming apparatus, comprising:

a rotatable image bearing member;

a transfer material bearing member for bearing a transfer material thereon, said transfer material bearing member having a circumferential length an integer number of times of that of said image bearing member and being driven independently of said image bearing member, and having a transfer material bearing sheet for bearing the transfer material thereon and a support member for supporting said transfer material bearing sheet, an image formed on said image bearing member being transferred onto the transfer material born by said transfer material bearing member at a transfer position;

a press member for pressing said transfer material bearing member against said image bearing member at the transfer position, a gap being formed between said transfer material bearing sheet and said image bearing member when pressing of the transfer material bearing member is released; and varying means for varying a relative position between a peripheral surface of said image bearing member and a peripheral surface of said transfer material bearing member;

wherein as said varying means varies a relative position between the peripheral surface of said image bearing member and the peripheral surface of said transfer material bearing member, said press member releases pressing against the transfer material bearing sheet without shifting the support member in a direction away from said image bearing member.

2. An image forming apparatus according to claim 1, wherein when said varying means varies the relative position between the peripheral surface of said image bearing member and the peripheral surface of said transfer material bearing member, said image bearing member rotates, and said transfer material bearing member stops rotation thereof.

3. An image forming apparatus according to claim 1, wherein when said varying means varies the relative position between the peripheral surface of said image bearing member and the peripheral surface of said transfer material bearing member, said transfer material bearing member rotates together with the support member and said image bearing member stops its rotation.

4. An image forming apparatus according to claim 1, wherein when said varying means varies the relative position between the peripheral surface of said image bearing member and the peripheral surface of said transfer material bearing member, said image bearing member and said transfer material bearing member rotate at different peripheral speeds thereof.

5. An image forming apparatus according to claim 1, wherein said press member has a sheet-like configuration.

6. An image forming apparatus according to claim 1, wherein said support member includes mutually opposed ring portions, and a connecting portion for connecting them, and said transfer material bearing sheet covers an aperture formed by said ring portions and said connecting portion.

7. An image forming apparatus according to claim 1, further comprising means for forming a latent image on said image bearing member, and developing means for developing the latent image with toner, wherein the developed image is electrostatically transferred onto the transfer material.

8. An image forming apparatus according to claim 7, wherein a charge polarity of said latent image and a charge polarity of said toner are the same.

9. An image forming apparatus according to claim 1, wherein said varying means varies the relative position after completion of a transfer operation for transferring the image formed on said image bearing member onto the transfer material.

10. An image forming apparatus according to claim 1, wherein plural images are sequentially superimposed on the transfer material born on said transfer material bearing member.

* * * * *

UNITED STATES PATENT AND TRADEMARK OFFICE

CERTIFICATE OF CORRECTION

PATENT NO. : 5,594,537

DATED : January 14, 1997

INVENTOR(S) : Yuji HASEGAWA

It is certified that error appears in the above-indentified patent and that said Letters Patent is hereby corrected as shown below:

On the Cover Page, Under References Cited
FOREIGN PATENT DOCUMENTS, ITEM [56]
"2148058 6/1990 Japan" should read
--2-148058 6/1990 Japan--.

COLUMN 1
Line 51, "in" should be deleted.

COLUMN 2
Line 4, "on" should be deleted.

COLUMN 3
Line 13, "to" should be deleted;
Line 25, "Also" should read --Also,--;
Line 34, "sheet 62." should read --sheet 62a,--;
Line 36, "sheet 62." should read --sheet 62a,--;
Line 39, "Further more" should read --Futhermore,--;
Line 45, "sheet 62," should read --sheet 6a,--.

COLUMN 4
Line 49, "in the" should be deleted.

COLUMN 5
Line 4, "drum 6" should read --drum 26--;
Line 57, "prevent" should read --to prevent--;
Line 60, "entire" should be deleted.

UNITED STATES PATENT AND TRADEMARK OFFICE

CERTIFICATE OF CORRECTION

PATENT NO. : 5,594,537
DATED : January 14, 1997
INVENTOR(S) : Yuji HASEGAWA

It is certified that error appears in the above-indentified patent and that said Letters Patent is hereby corrected as shown below:

COLUMN 6
Line 8, "example" should read --example,--;
Line 39, "in case the" should read --in the case--.

Signed and Sealed this
Eighth Day of July, 1997

Bruce Lehman

*Attest:*

BRUCE LEHMAN

*Attesting Officer*

*Commissioner of Patents and Trademarks*